United States Patent [19]

Frazita et al.

[11] 4,041,501

[45] Aug. 9, 1977

[54] LIMITED SCAN ARRAY ANTENNA SYSTEMS WITH SHARP CUTOFF OF ELEMENT PATTERN

[75] Inventors: Richard F. Frazita, Deer Park; Alfred R. Lopez, Commack; Richard J. Giannini, Setauket, all of N.Y.

[73] Assignee: Hazeltine Corporation, Greenlawn, N.Y.

[21] Appl. No.: 594,934

[22] Filed: July 10, 1975

[51] Int. Cl.[2] ..... H01Q 3/26

[52] U.S. Cl. ..... 343/844; 343/100 SA; 343/854

[58] Field of Search ..... 343/778, 779, 854, 853, 343/100 SA

[56] References Cited

U.S. PATENT DOCUMENTS

| | | | |
|---|---|---|---|
| 2,268,844 | 1/1942 | Polkinghorn | 343/854 |
| 3,803,625 | 4/1974 | Nemit | 343/778 |
| 3,964,066 | 6/1976 | Nemit | 343/854 |

*Primary Examiner*—Eli Lieberman

[57] ABSTRACT

Disclosed are array antenna systems wherein the effective element pattern is modified by means of coupling circuits to closely conform to the ideal element pattern required for radiating the antenna beam within a selected angular region of space. Use of the coupling circuits in the embodiment of a scanning beam antenna significantly reduces the number of phase shifters required as compared to prior art array antennas.

38 Claims, 16 Drawing Figures

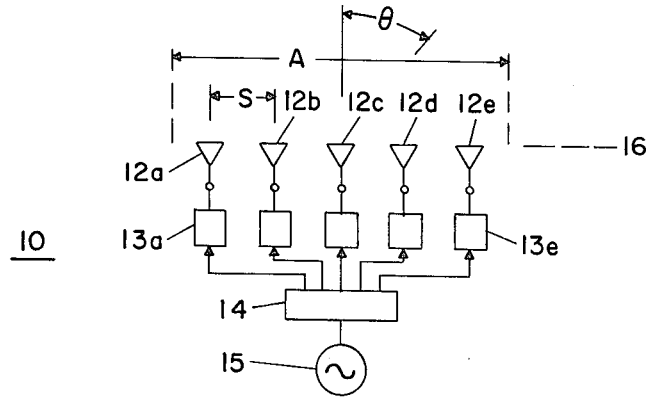
FIG. 1 (PRIOR ART)
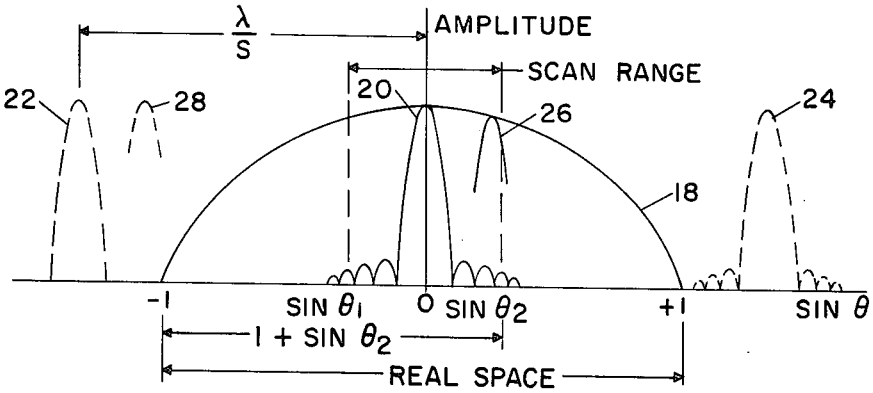
FIG. 2 (PRIOR ART)
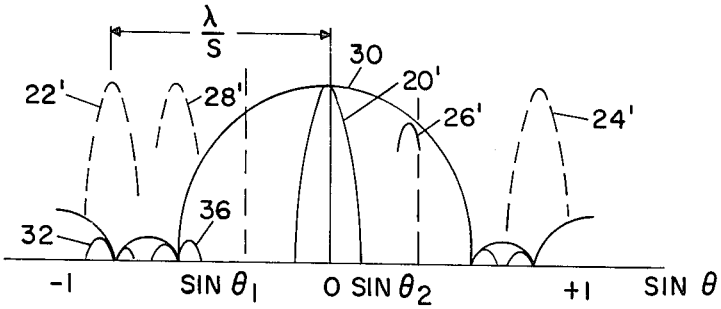
FIG. 3 (PRIOR ART, NEMIT)
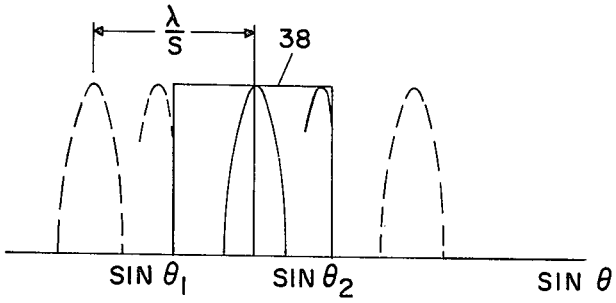
FIG. 4 (IDEAL)

(IDEAL)

LIMITED SCAN ARRAY ANTENNA SYSTEMS WITH SHARP CUTOFF OF ELEMENT PATTERN

BACKGROUND OF THE INVENTION

This invention relates to phased array antenna systems and in particular to a technique for reducing the number of phase shifters or other active components in a phased array which must radiate within only a limited region of space.

Conventional phased array antenna systems are well known and usually have a phase control unit associated with each of the radiating elements. Phase control units require electronic components and are very often the most expensive part of a phased array system. When a conventional phased array having a phase control device associated with each element of the array is required to scan only a limited portion of real space, that is less than plus or minus 90° from broadside, such an array has more scan capability than required, and the large number of phase control units results in a high system cost.

A phased array system should ideally have approximately one active control unit, for example, a phase shifter or switch, for each beam width it is required to scan. There are prior art systems for scanning an antenna beam over a limited region of space using approximately one control unit for each beam width. These systems usually utilize switching techniques to select the desired beam. For example, the well-known Butler Matrix may be used in conjunction with a switching circuit and an array of elements, so that by switching the source of wave energy signals to the various inputs of the Butler Matrix, the antenna beam is switched to various beam positions A similar result may be achieved by optically illuminating a focusing device from a variety of feed locations. One such technique is described in U.S. Pat. No. 3,881,178, Peter W. Hannan, entitled "Antenna System for Radiating Multiple Planar Beams", which is assigned to the same assignee as the present invention.

In U.S. Pat. No. 3,803,625, entitled "Network approach for Reducing the Number of Phase Shifters in a Limited Scan Phased Array", Nemit describes a technique for reducing the number of phase shifters required in a limited scan array. Nemit's technique involves the use of overlapping sub-arrays of antenna elements each of which is associated with a phase shifter. Each sub-array has a pattern which suppresses the amplitudes of grating lobes in real space, thereby enabling a larger spacing between sub-arrays than would be allowable in a conventional array wherein each sub-array is a single element. In his patent, Nemit describes a condition which may achieve an ideal sub-array pattern and discloses the criteria for arriving at the minimum necessary number of phase control units. Nemit does not, however, describe a practical technique for acheving the ideal sub-array pattern.

The technique described by Nemit involves the direct physical interconnecting of each sub-array input port with all of the antenna elements to be excited by wave energy signals supplied to that input port. This approach cannot be practically implemented to achieve a near ideal sub-array radiation pattern, because it requires an excessive number of individual interconnecting transmission lines, particularly in an actual array which has a large number of radiating elements.

OBJECTS OF THE INVENTION

It is, therefore, an object of the present invention to provide a new and improved array antenna system having a reduced number of active control units.

It is a further object of the present invention to provide such a system or radiating within only a limited selected region of space with the minimum number of active control units.

It is a still further object of the present invention to provide a practical network for implementing such an array system without individual interconnecting transmission lines between each array input port and all of the elements to be excited in response to signals supplied to that input.

In accordance with the present invention, there is provided an antenna system for radiating wave energy signals into a selected region of space and in a desired radiation pattern. The system includes an aperture comprising a plurality of element groups, each group comprising two or more radiating elements. There is further provided a plurality of first coupling means, each for coupling suppiied wave energy signals to the elements in a corresponding one of the element groups. Finally, there is included second coupling means for interconnecting the plurality of first coupling means to cause wave energy signals supplied to any of the first coupling means to be additionally coupled to selected elements in substantially all of the remaining element groups of the aperture with predetermined amplitudes and phases, thereby causing the aperture to radiate wave energy signals primarily in the selected region of space. When wave energy signals are supplied to the first coupling means with a predetermined amplitude and phase, the aperture is caused to radiate wave energy signals in the desired radiation pattern.

BRIEF DESCRIPTION OF THE DRAWINGS

FIG. 1 is a schematic diagram of a conventional phased array antenna in accordance with the prior art.

FIG. 2 illustrates the element pattern and array pattern of the FIG. 1 antenna system.

FIG. 3 illustrates the sub-array pattern and array pattern of a prior art array constructed in accordance with the teachings of Nemit.

FIG. 4 illustrates an ideal sub-array pattern and array pattern.

DESCRIPTION OF PRIOR ART

Figure 9:
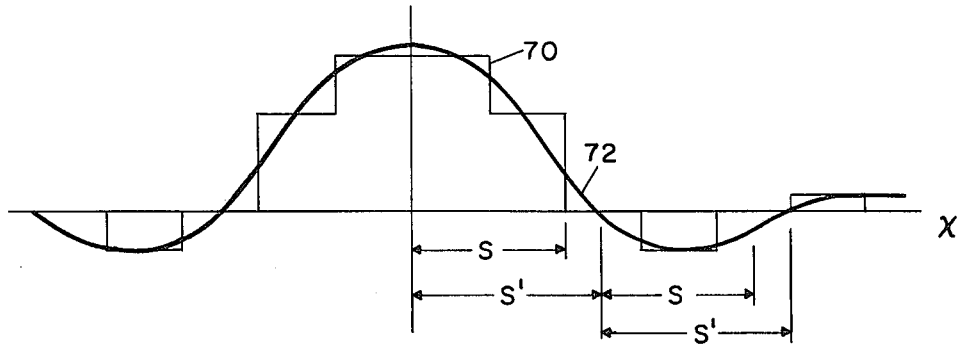
FIG. 9 illustrates the aperture excitation achieved from the antenna configuration of FIG. 6.

FIG. 1 is a schematic illustration of a simplified phased array antenna 10 in accordance with prior art. The antenna 10 includes five radiating elements 12*a* through 12*e* which are arranged along array axis 16 and are spaced from each other by a center-to-center distance S. The entire aperture occupies a linear aperture dimension A. Each of the array elements 12 is coupled to power divider 14 via a corresponding one of the phase shifters 13*a*–13*e*. Wave energy signals from signal generator 15 and power divider 14 are supplied to antenna elements 12 by phase shifters 13 such that a proper selection of the relative phase values for phase shifters 13 causes antenna elements 12 to radiate a desired radiation pattern into a selected angular region of space. Variation of the phase values of phase shifters 13 will cause the radiated antenna pattern to change direction with respect to angle $\theta$ in space.

The properties of phased array 10 and techniques for selecting design parameters, such as aperture length A and element spacing S are well known in the antenna art. A review of these parameters is deemed appropriate, however, since it will facilitate an understanding of the present invention with respect to the prior art.

FIG. 2 illustrates the radiation characteristics of the FIG. 1 array antenna. The patterns in FIG. 2 are plotted as amplitude (vertically) versus the sine (horizontally) of the radiation angle $\theta$, indicated in FIG. 1. In FIG. 2 the amplitude pattern 18 corresponds to the radiated pattern associated with each of the radiating elements 12. Pattern 20 is the array pattern achieved by supplying all of the elements 12 with wave energy signals of equal amplitude and equal phase, assuming that the elements radiate wave energy with equal amplitude in all directions. The actual radiated pattern of the antenna system 10 is determined by multiplying the element pattern 18 by the array pattern 20. In addition to the array pattern 20 at 0° scan angle, there also exists additional element array patterns or lobes in sine $\theta$ space which are separated from the main lobe by a distance of $\lambda/S$, where $\lambda$ is the wavelength of the radiated signals and S is the spacing between the centers of array element 12. Two such additional lobes which are known as grating lobes, are illustrated as 22 and 24 in FIG. 2. It will be recognized that grating lobes 22 and 24 are located at values of sine $\theta$ less than minus one and greater than plus one. These lobes are therefore in imaginary space and result in no actual radiation pattern from phased array 10.

When the phase of wave energy signals supplied to elements 12 of array 10 is changed to have a linear phase slope, by changing the values of phase shift introduced by phase shifters 13, the array pattern will be moved to a different radiation angle. Illustrated in FIG. 2 is the main lobe 26 which will result when phase control units 13 are adjusted to scan the main pattern of array 10 to one edge of a selected sector of space.

The selected angular region of space is illustrated in FIG. 2 as a scan range which varies from angle $-\theta_1$ to angle $+\theta_2$. Those skilled in the art will recognize that main beam 26 will have an amplitude which is somewhat reduced from the amplitude of broadside main beam 20 on account of the slope of the element pattern 18. As may also be seen from FIG. 2, scanning of the main beam 20 to the direction indicated by main beam 26 will also cause grating lobes 22 and 24 to move by a corresponding amount. This is shown in FIG. 2 where grating lobe 28 which is on the edge of real space and illustrates the position of grating lobe 22 when main lobe 20 is scanned to the location illustrated by main lobe 26.

In accordance with the prior art, the spacing S between elements 12 in FIG. 1 is chosen so that, when the main antenna beam is scanned to the extreme angles within a selected angular region of space, the undesired grating lobes will still radiate in a direction which is in imaginary space and will therefore result in no spurious radiation from the array. In general, the spacing S between adjacent elements must be less than $\lambda/(1 + \text{sine } \theta_{max})$ where $\theta_{max}$ is the maxiumum angular deviation of the main beam from broadside or 0° scan angle. In fact, this spacing must be less than the amount indicated by a factor which allows for the finite beam width of the grating lobe in sine $\theta$ space. The result of this selection of the element spacing S is illustrated in FIG. 2. The spacing between grating lobes in sine $\theta$ space is equal to $\lambda/S$. Selection of S as indicated results in the first grating lobe being located sufficiently into imaginary space, when the array is scanned to broadside, that the grating lobe does not enter real space when the array is scanned to $\theta_{max}$.

Since the overall length A of the array aperture is determined by the desired beam width of the radiated pattern, the number of antenna elements and consequently the number of phase control units 13 in the array antenna of FIG. 1 is determined by the maximum allowable spacing S between adjacent elements. It is well recognized that it is desirable to maximize the element spacing S to achieve a minimum number of radiating elements 12 and phase control units 13 in order to minimize the cost of the array antenna. When the angular region of space over which it is desired that the array antenna be capable of radiating the desired pattern is small, for example, in the order of ten antenna beam widths, it is theoretically possible to reduce the number of phase control units 13 required in the array 10.

One approach to reducing the number of phase control units for a limited scan array has been described by Nemit in U.S. Pat. No. 3,803,625. Nemit's approach is to associate each phase control unit with a sub-array consisting of three adjacent antenna elements. Each of Nemit's sub-array includes a central element which is supplied with wave energy signals exclusively by the phase control unit associated with the particular sub-array, and two or more additional array elements which are supplied with wave energy signals both by the phase control unit associated with that sub-array and the phase control units associated with the adjacent sub-arrays. Using this method, Nemit achieves overlapping sub-array modules, each having at least three radiating elements. The result of this configuration is that wave energy signals supplied to each sub-array are radiated in approximately the sub-array pattern 30 illustrated in FIG. 3. As compared to the element pattern 18 illustrated in FIG. 2 for a conventional array, Nemit achieves an increased fall off of the element pattern in the region of real space outside the selected region within which the array is to radiate. By using the sub-array pattern which results from the simultaneous excitation of multiple radiating elements, as a basic element pattern of the array, Nemit achieves an increased spacing between phase control units in his array. For example, FIG. 5 of the Nemit patent illustrates a linear phased array having approximately the same element spacing as would be associated with the prior art array of FIG. 1, but having a phase control unit associated with only every other radiating element, rather than every radiating element. This technique therefore results in a one-half reduction in the number of phase control units required for a limited scan array antenna.

The effect of the arrangement of elements and the interconnecting of sub-arrays described by Nemit is illustrated in FIG. 3, which shows the sub-array pattern 30 which results from supplying wave energy signals to Nemit's three element sub-arrays. Because Nemit applies phase control only to every other element in the array the grating lobes associated with the phase control in his array are closer to the main lobe 20° of the array and, as illustrated in FIG. 3, grating lobes 22' and 24' are in real space. Because of the shape of the sub-array pattern 30, the effect of the presence of grating lobes 22' and 24' is reduced due to the rapid fall off of the sub-array pattern 30 in the region outside the selected scan range. Grating lobes 22' and 24' radiate only as minor side lobes 32 and 34 and have little effect on the desired characteristics of the array. As the main beam 20' is scanned to a position 26' within the selected sector of space, grating lobe 22' will move to position 28', which is still within a region where the sub-array pattern 30 is at a low amplitude, resulting in minor side lobe 36. In accordance with the teaching of Nemit, the spacing S' between sub-arrays and, consequently, the phase-control spacing is chosen so that the grating lobe does not enter the sub-array pattern when the array is scanned to the edge of the scan range.

Figure 5:
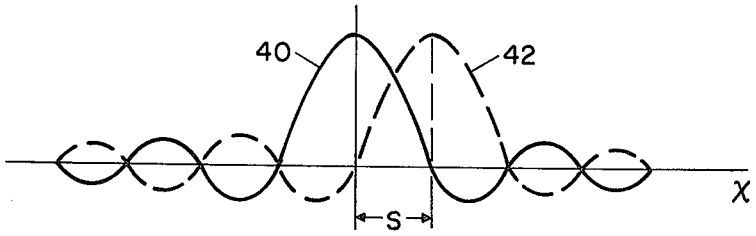
FIG. 5 is an illustration of the amplitude and polarity of an antenna aperture excitation which will achieve the ideal sub-array pattern illustrated in FIG. 4.

In his specification, particularly with regard to his FIG. 4, Nemit describes an ideal sub-array pattern which would result in the maximum allowable spacing between phase control units in an array aperture. This ideal sub-array pattern 38, illustrated in FIG. 4, has uniform amplitude within the scan range and has zero amplitude in all other regions of space. If this sub-array pattern could be achieved, it would be possible to have sub-array spacing which is equal to $\lambda/|\sin\theta_1 - \sin\theta_2|$. This spacing results in a number of phase control units approximately equal to the number of antenna beam widths within the selected region of space. FIG. 5 illustrates the aperture sub-array excitation 40 required to achieve the ideal sub-array pattern 38 illustrated in FIG. 4. This ideal illumination is in the form of the function sin Kx/Kx where $x$ is the center-to-center distance along the aperture between effective sub-arrays and $K = \pi/\lambda|\sin\theta_1 - \sin\theta_2|$. To achieve the ideal pattern, the aperture would have to be infinite in length. As a practical matter, the ideal pattern is approached by having each sub-array illumination 40 coextensive with the entire array aperture. Also illustrated in FIG. 5 is the sub-arry illumination 42 associated with the sub-array adjacent to that which results in sub-array illumination 40. These illuminations are spaced by the effective sub-array spacing S. The ideal array would have a phase control unit associated with each of these overlapping sub-array aperture illuminations.

In the ideal sub-array illumination depicted in FIG. 5, the effective element spacing S between sub-array illuminations is equal to the first null distance on the sub-array illumination, $\lambda/|\sin\theta_1 - \sin\theta_2|$. The effective element spacing determines the spacing in sine $\theta$ space, $\lambda/S$, between grating lobes in the array pattern. The first null distance of the sub-array illumination determines the angular width of the resulting ideal sub-array pattern 38. In general, to avoid the presence of undesired grating lobe radiation, the first null spacingof the sub-array illumination must be greater than the effective element spacing S, so that when the main beam is steered to either edge of the ideal sub-array pattern, the first grating lobe will not be within the sub-array pattern.

DESCRIPTION AND OPERATION OF THE EMBODIMENT OF FIG. 6

Figure 6:
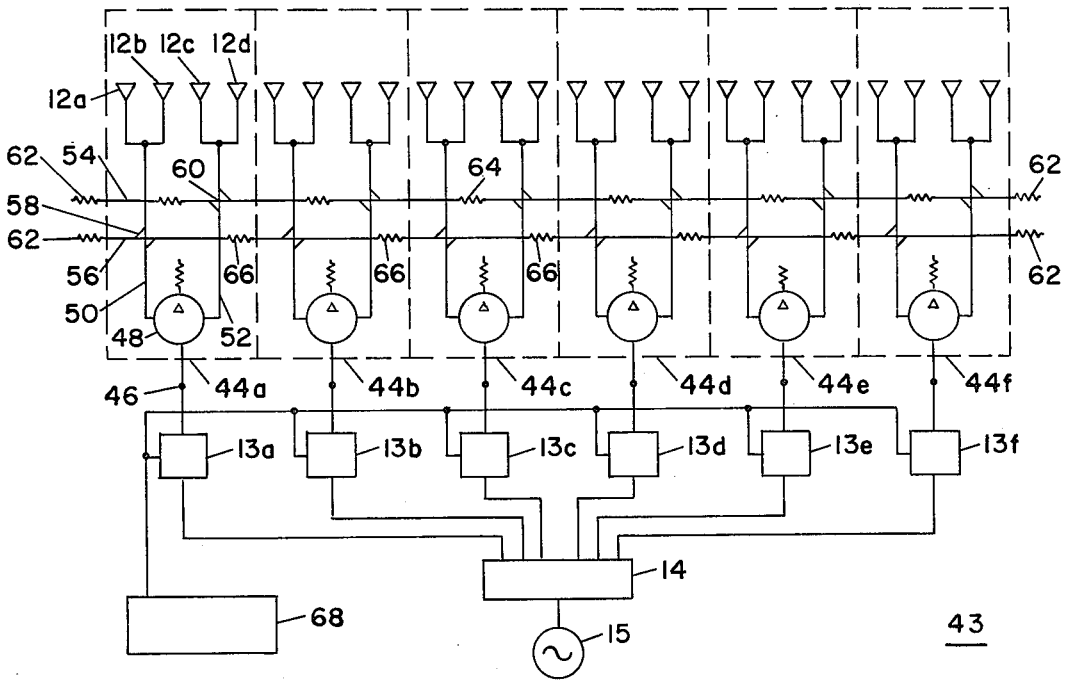
FIG. 6 is a schematic representation of a phased array antenna system built in accordance with the present invention.

FIG. 6 illustrates an antenna system 43 for radiating wave energy signals into a selected angular region of space, such as the scan range illustrated in FIG. 2, built in accordance with the present invention. Antenna system 43 includes a plurality of element groups, each group comprising four radiating elements **12*a* through 12*d*. Also included are a plurality of first coupling means, each associated with one of the element groups, and each comprising a hybrid power divider 48 and transmission lines 50 and 52 for coupling wave energy signals supplied to input terminal 46 to the elements in the corresponding element group. There is further provided second coupling means comprising transmission lines 54 and 56 and couplers 58 and 60** interconnecting the plurality of first coupling means to cause wave energy supplied to any of the first coupling means to be additionally supplied to selected elements in the remaining element groups of the array.

Figure 12:
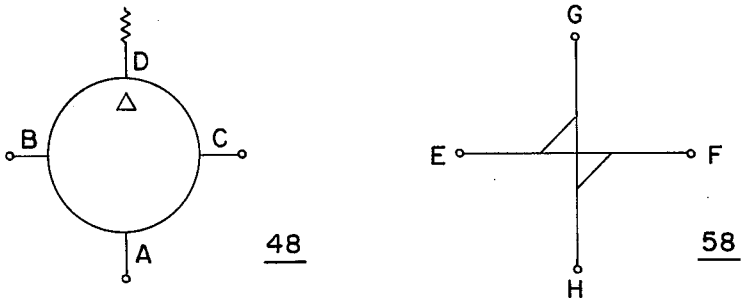
FIG. 12 illustrates the conventions used in the antenna schematic diagrams of FIGS. 6, 7, 13 and 14.

Antenna system 43 is arranged in six modules **44*a* through 44*f*, each including an element group comprising four radiating elements 12*a*, 12*b*, 12*c* and 12*d* and the first coupling means. Module 44 includes a power divider 48, which is commonly called a hybrid power divider and is further illustrated in FIG. 12. Hybrid 48, as shown in FIG. 12,** has four signal ports designated A, B, C and D. Port A is known as the sum port and signals supplied to port A are equally divided and appear as outputs in ports B and C with equal phase. Port D, which is labeled Δ, is known as the difference port, and is isolated from port A. Signals supplied to ports B and C which have unequal amplitude or phase are supplied to port D in proportion to their vector difference and to port A in proportion to their vector sum.

The B and C outputs of power divider 48 in module 44 are connected by transmission lines 50 and 52 to elements **12*a*, 12*b*, 12*c* and 12*d*. The four elements, 12*a* through 12*d*, from an element group. The element group consists of two element modules, one module comprising elements 12*a* and 12*b*, and the second module comprising elements 12*c* and 12*d*. It may be seen from the configuration of module 44*a* that elements 12*a* and 12*b* are always supplied with equal wave energy signals and, likewise, elements 12*c* and 12*d*** are always supplied with equal wave energy signals.

Antenna system 43 additionally includes transmission lines 54 and 56 which are selectively coupled by directional couplers 58 and 60 to transmission lines 50 and 52 in each of the module 44. Each end of transmission lines 54 and 56 is terminated in its characteristic impedance by one of the resistors 62. Within each module transmission line 54 contains an attenuator 64 and transmission line 56 contains an attenutor 64 and transmission line 56 contains an attenuator 66.

The characteristics of directional couplers 58 and 60 may be specified using the diagram in FIG. 12. FIG. 12 illustrates directional coupler 58 having four transmission line ports E, F, G and H. Wave energy signals supplied to port E are directly coupled to port F and additionally coupled to port G by the coupling coefficient of the directional coupler. Signals supplied to port E are not supplied to port H. The signals coupled to port G are advanced in phase by 90° with respect to the output signal at port F. The characteristics of such directional couplers are well known in the art and it will be recognized that similar transmission properties occur when wave energy signals are supplied to any of the remaining ports of the directional coupler.

Also shown in connection with antenna system 43 are phase shifter 13, power divider 14 and signal generator 15 which are identical to the corresponding components in the prior art FIG. 1 phased array. Also shown is control unit 68 which generates phase commands for phase shifters 13, the operation of which is well known in the art.

Antenna system 43, particularly as a result of the use of transmission lines 54 and 56 in conjunction with couplers 58 and 60 causes wave energy signals supplied to any of the input terminals 46 of modules 44 to be supplied to the elements of the element group within that particular module, and to be additionally supplied to selected elements in the remaining element groups of the array. The objective of this coupling is to achieve, in response to wave energy signals supplied to any input terminal 46, an aperture excitation which approximates the ideal aperture excitation illustrated in FIG. 5, and therefore an effective element pattern which closely corresponds to the ideal element pattern illustrated in FIG. 4.

By way of illustrating the operation of antenna system 43, it will be useful to trace the aperture excitation which results from supplying wave energy signals to a typical module. Wave energy signals supplied to input 46 are divided by power divider 48 and supplied in equal amplitude and equal phase by transmission lines 50 and 52 to radiating elements 12*a* through 12*d* in the corresponding element module 44*a*. The signals on transmission line 50 are additionally coupled by directional coupler 58 to transmission line 56 in a direction going to the right in FIG. 6. Signals on transmission line 52 are coupled to transmission line 54 by directional coupler 60 in a direction going to the left to FIG. 6. The effect of the signals coupled to transmission lines 54 and 56 is most easily illustrated by considering the effect of these coupled signals on a central module in the array. As an example, if the signals are supplied to input terminal 46*c* of module 44*c*, coupled signals on transmission line 54 travel to the left and are supplied by directional couplers 60 in modules 44*a* and 44*b* to radiating elements 12*c* and 12*d* in modules 44*a* and 44*b*. The signals supplied to elements 12*c* and 12*d* of module 44*b* are in phase with the signals supplied to elements 12*c* and 12*d* of module 44*c* because the length of transmission line 54 between directional coupler 60 in module 44*b* and directional coupler 60 in module 44*c* has been chosen to have a phase length of 180°. This phase length is in addition to a 90° phase shift which results from passage of the signal through coupler 60 in module 44*c* and through coupler 60 in module 44*b*. Since the total phase shift of the signal coupled from transmission line 52 in module 44*c* to transmission line 52 in module 44*b* is 360°, the signals supplied to elements 12*c* and 12*d* in module 44*b* have the same phase as the signals supplied to all the elements in module 44*c*. The amplitude of the signals coupled to elements 12*c* and 12*d* in module 44*b* is reduced by the coupling coefficient of coupler 60 in module 44*c*, the attenuation of attenuator 64 and the coupling coefficient of coupler 60 in module 44*b*.

It will be recognized by those skilled in the art that signals which are coupled to elements 12*a* and 12*b* of module 44*c* are similarly coupled by directional coupler 58, transmission line 56, attenuator 66, and directional coupler 58 of module 44*d* to elements 12*a* and 12*b* of module 44*d* with the same phase as the signals supplied to all the elements in module 44*c*.

FIG. 9 illustrates aperture excitation 70 which results from the coupling circuits of antenna system 43 in response to signals supplied to input terminal 46 of module 44*c*. The location and scale of aperture excitation 70 illustrated in FIG. 9 has been selected to correspond to the adjacent antenna elements of FIG. 6. The coupling technique which has been described thus far results in the central portion of aperture excitation 70 illustrated in FIG. 9. Signals supplied to input terminal 46*c* of module 44*c* are supplied by transmission lines 50 and 52 to elements 12*a* through 12*d* of module 44*c* with equal amplitude and phase, resulting in the high amplitude central portion of aperture excitation 70 illustrated in FIG. 9. The signals which are coupled, with reduced amplitude and equal phase to elements 12*c* and 12*d* of module 44*b* and to elements 12*a* and 12*b* of module 44*d* result in the remaining portion of the central part of aperture excitation 70 illustrated in FIG. 9.

It has been noted that because of the directional nature of couplers 58 and 60, signals on transmission line 56 travel only to the right and signals on transmission line 54 travel only to the left. Elements 12*a* and 12*b* of module 44*b* therefore receive no wave energy signal in response to signals supplied to input terminal 46*c* of module 44*c*. The same is true of elements 12*a* and 12*b* of module 44*a*. Likewise, no signals are coupled to elements 12*c* and 12*d* of modules 44*d*, 44*e* and 44*f*. It will be noted that the portions of aperture excitation 70 corresponding to these antenna elements have zero amplitude.

Signals on transmission line 54 are coupled to elements 12*c* and 12*d* of module 44*a* with an amplitude reduced from the amplitude of the signals coupled to the corresponding elements of module 44*b* by reason of attenuator 64 and with an inverted phase by reason of an additional 180° transmission line length. This coupling is illustrated in FIG. 9 as the first left hand side lobe of aperture excitation 70. Similarly, signals are coupled to elements 12*a* and 12*b* of modules 44*e* and 44*f*. The signals coupled to module 44*e* are opposite in polarity to the signals supplied to the elements in module 44*c*, and the signals supplied to the elements in module 44*f* have the same polarity as the signals supplied to the elements in module 44*c*. These signals correspond to the first and second right hand side lobes of aperture excitation 70 illustrated in FIG. 9.

Figure 8:
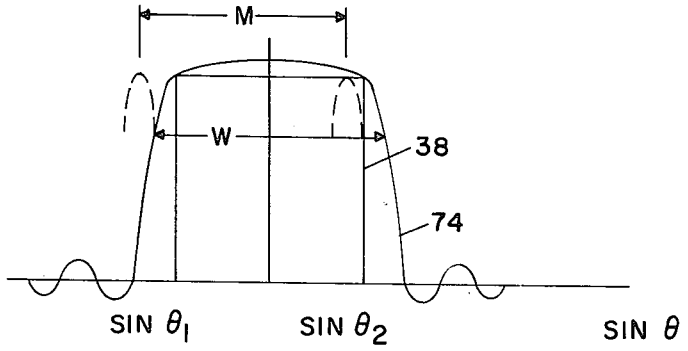
FIG. 8 illustrates a typical sub-array pattern and array pattern which can be achieved using the antenna configuration illustrated in FIG. 6.

As may be seen from the diagram, the amplitude and polarity of aperture excitation 70 in FIG. 9 is an approximation of sin $Kx/Kx$ function 72 also illustrated in FIG. 9. The first null point of function 72 occurs at a distance S' from the center of module 44c. This first null point distance determines the width W of the effective element pattern 74 illustrated in FIG. 8. It should be noted that the actual aperture excitation 70 only approximates function 72 over a finite distance since the phase reversals of the aperture excitation side lobes occur at points on the aperture separated by the spacing S between corresponding elements in adjacent element groups, while the phase reversal points of function 72 occur at a periodicity S'. This difference has no significant effect over the aperture of most practical antenna systems. The spacing S between corresponding elements in adjacent element groups determines the effective element spacing of the array and consequently the distance M illustrated in FIG. 8 between the main lobe and the first grating lobe in sin $\theta$ space. Since S is less than S' for the antenna system 43, the grating lobe will remain outside the effective element pattern 74 for all conditions of scanning of the main beam within the desired angular sector between $\theta_1$ and $\theta_2$. As may also be seen by the illustration of FIG. 8, the effective sub-array pattern 74 closely approximates the ideal sub-array pattern 38, considering the finite length of the radiating aperture and quantization of the aperture illumination 70. The net result is that the effective sub-array spacing, that is, the distance between corresponding elements of modules 44 in array 43 may closely approximate the ideal spacing, $\lambda/[\sin\theta_1 - \sin\eta_2]$.

Figure 15:
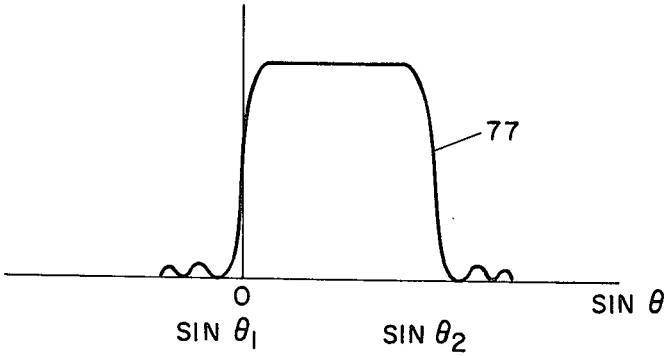
FIG. 15 illustrates a sub-array pattern in accordance with the present invention which is assymetrical with respect to the broadside axis.
Figure 16:
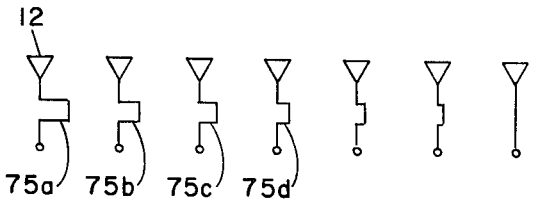
FIG. 16 illustrates a technique for achieving the sub-array pattern of FIG. 15 utilizing an array in accordance with the present invention.

In many cases, it may be desired that the angular region of space, within which the antenna system is to scan, be assymetrical with respect to the broadside axis of the array. In this case by introducing linear phase progression on said aperture, the sub-array pattern may be shifted accordingly as illustrated in FIG. 15 where the sub-array pattern is from $\theta_1 = 0$ to $\theta_2$. This sub-array pattern is achieved by the inclusion of phase shifters, comprising transmission lines 75 illustrated in FIG. 16, or the like between the antenna elements 12 and the remainder of the coupling network. Those skilled in the art will recognize that if switchable phase shifters are used in place of transmission lines 75 the sub-array pattern may be shifted to two or more discrete locations.

As an example of an array designated in accordance with the embodiment of FIG. 6 for operation at 5.2 GHz. with an aperture length of 34.2 wavelengths where the desired angular region of space is 0° to 14° scan angle $\theta$, the spacing between corresponding elements 12a in adjacent modules 44 might be 4.14 wavelengths. The value for the coupling coefficient of couplers 58 and 60 would be 0.69 and the attenuation coefficient for attenuators 64 and 66 would be 0.69. These values are suitable where the signal inputs for the modules 44 are designed to have an amplitude distribution of $0.5 + 0.5 \text{ cosine}^2(\pi x/A)$, where A is the total aperture length and $x$ is the distance of the center of the module from the center of the array.

DESCRIPTION OF THE EMBODIMENT OF FIG. 10

Figure 10:
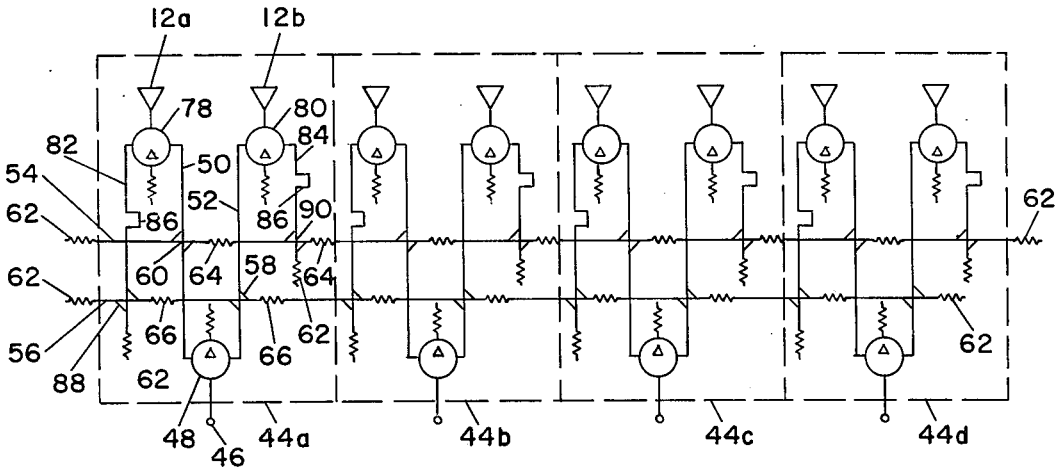
FIG. 10 is a schematic diagram of another antenna configuration in accordance with the present invention, which achieves a more nearly ideal sub-array pattern.

Illustrated in FIG. 10 is an embodiment of the invention wherein the resulting aperture excitation more closely approximates the ideal excitation 40. As noted above, the embodiment of FIG. 6 results in an excitation 70 which has a sidelobe periodicity S which is not precisely equal to the first null spacing S'. This minor defect is avoided in the embodiment of FIG. 10 at the expense of increased system complexity and cost.

In the embodiment of FIG. 10, each of the modules 44 includes a hybrid power divider 48 and transmission lines 50 and 52 for coupling wave energy signals supplied to input 46 to elements 12a and 12b. The elements 12a and 12b are equivalent to the element modules in the embodiment of FIG. 6. Each of the elements 12 are of larger size and hence electrically equivalent to a pair of the elements utilized in the FIG. 6 antenna system. Transmission line 50 is not directly connected to element 12a but is connected to the B port of hybrid 78. Likewise transmission line 52 is connected to the C port of hybrid 80. The C port of hybrid 78 is connected by transmission line 82 and coupler 88 to interconnecting transmission line 56. Likewise the B port of hybrid 80 is connected by transmission line 84 and coupler 90 to interconnecting transmission line 54. Transmission lines 82 and 84 include fixed phase-shifting line lengths 86 and are terminated in resistors 62.

Figure 11:
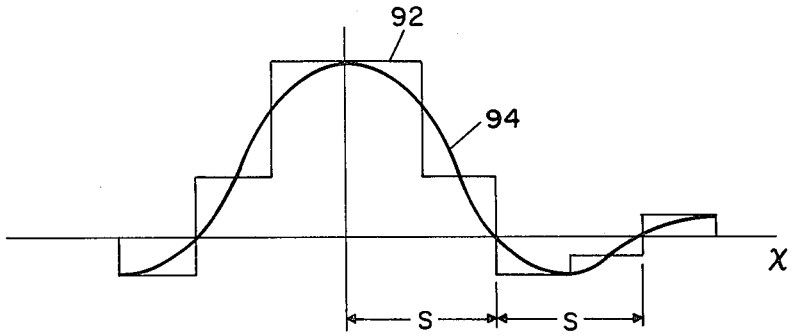
FIG. 11 illustrates the aperture excitation achieved using the antenna configuration of FIG. 10.

Wave energy signals supplied to the input 46 of module 44b of the array antenna of FIG. 10 form aperture excitation 92 illustrated in FIG. 11, which is a close approximation and has the same side lobe periodicity as sin $Kx/Kx$ function 94. Such signals are supplied by power divider 48 and transmission lines 50 and 52 of module 44b to power divider 78 and 80 of module 44b. Signals coupled by coupler 58 to interconnecting line 56 are coupled by coupler 88 and transmission line 82 to port C of power divider 78, and signals coupled by coupler 60 to interconnecting line 54 are coupled by coupler 90 and transmission line 84 to port B of power divider 80. The transmission line between coupler 58 and coupler 88 and the transmission line between coupler 60 and coupler 90 are each selected to have 90° phase shift. The signals supplied to port C of power divider 78 and port B of power divider 80 are therefore in phase with the signals supplied to port B of power divider 78 and port C of power divider 80, since they undergo four successive 90 degree phase shifts: e.g., coupler 58, transmission line 56, coupler 88, phase shift 86. Signals reaching ports B and C of power dividers 78 and 80 are therefore in phase and therefore predominantly combine in ports A, which are connected to elements 12a and 12b of module 44b, with some energy being dissipated in the termination connected to port D of power dividers 78 and 80 of module 44b.

As in the embodiment of FIG. 6, energy on transmission line 54 is coupled to modules to the right of module 44b, while energy on transmission line 56 is coupled to modules to the left of module 44b. Energy on transmission line 56 is coupled to element 12b of module 44c by coupler 58 with the same phase as energy supplied to element 12 of module 44b. Energy supplied to element 12a by coupler 88 of module 44a undergoes an additional 180° of phase shift from the additional length of transmission line 56 and phase shifter 86 and is therefore out of phase with the energy supplied to elements 12 of module 44b. Energy is similarly coupled to all of the elements 12 of modules 44c and 44d by transmission line 54. The resulting aperture excitation 92 illustrated in FIG. 11 closely resembles the ideal excitation 94 and has the correct null spacing S for all side lobes.

Figure 7:
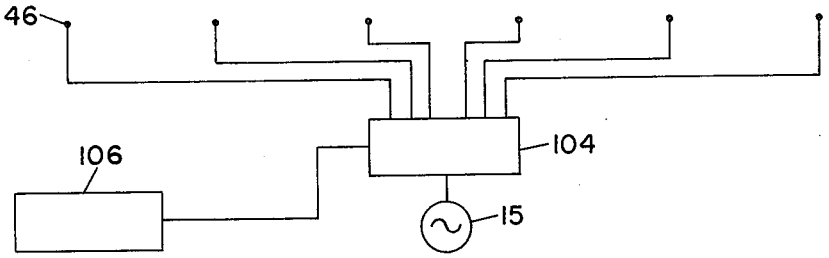
FIG. 7 is a schematic representation of apparatus for supplying wave energy signals to the FIG. 6 antenna unit to achieve a doppler radiation pattern.
Figure 13:
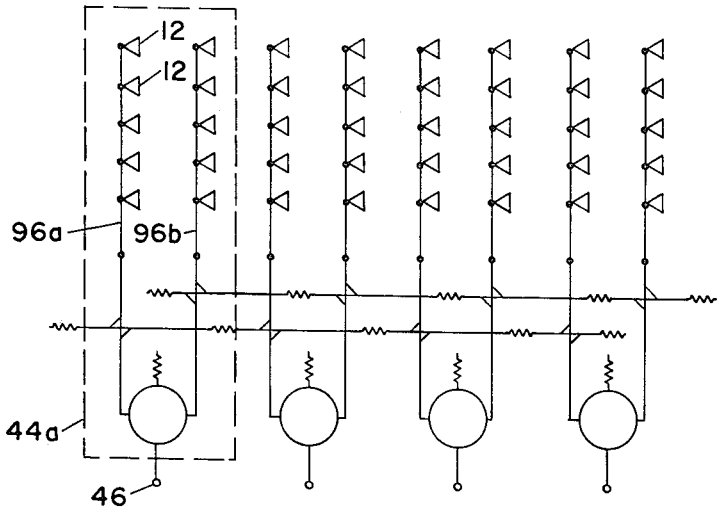
FIG. 13 is a schematic diagram of a planar array of element columns in accordance with the present invention.
Figure 14:
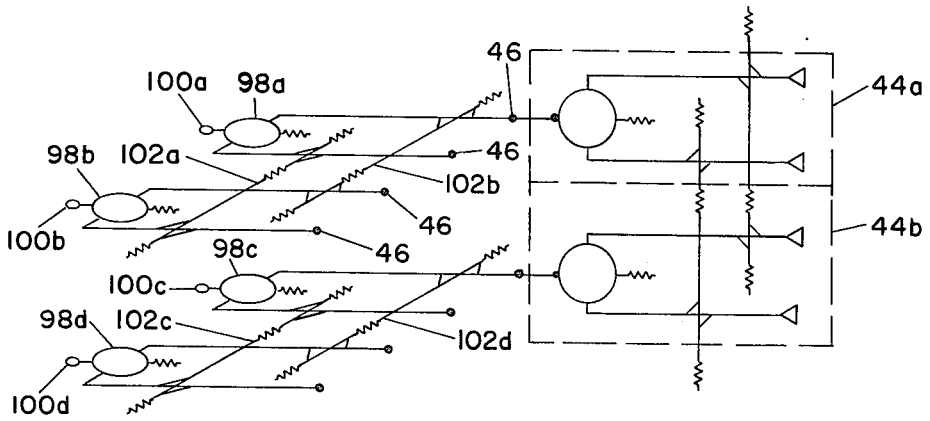
FIG. 14 is a partial schematic diagram of a planar array in accordance with the present invention for scanning a beam in two dimensions.

DESCRIPTION OF THE EMBODIMENTS OF FIGURES 13, 14 and 7

FIG. 13 illustrates an embodiment of the invention which is a planar phased array comprising columns 96 of elements 12. Each of the modules of the array 44 includes a group of columns 96. In all other respects the array of FIG. 13 is similar to the linear array 43 illustrated in FIG. 6.

FIG. 14 illustrates an embodiment of the invention comprising a planar array capable of being scanned in two orthogonal angular coordinates. The array includes columns of modules 44 which are similar to the modules of the array 43 of FIG. 6. To clarify the illustration, only one of four columns is illustrated. The input ports 46 of the array columns are supplied with wave energy signals in a manner similar to the coupling circuits used in each column. Signals supplied to input ports 100 are coupled by power dividers 98 to corresponding input ports in adjacent columns and simultaneously coupled by transmission lines 102 to corresponding input ports in the remaining columns of the array. In this manner the invention may be applied to arrays designed for scanning in orthogonal coordinates.

While the present invention has been described with respect to scanning beam array antennas, those skilled in the art will recognize that the same principles apply to antennas which radiate a pattern wherein the frequency of the radiated pattern varies with radiation angle. Such an antenna system may be implemented using the antenna of FIG. 6 wherein the power divider 14, phase shifters 13 and control unit 68 are replaced with the single pole multi-throw switch 104 and control unit 106 of FIG. 7. Utilizing the switch 104 , wave energy signals may be sequentially applied to module input ports 46 to generate a frequency coded or "Doppler" radiation pattern.

While the invention has been described and is claimed with respect to transmitting antennas, those skilled in the art will recognize that such antenna systems are reciprocal and the principles apply equally to receiving antennas. This specification and appended claims are therefore intended to apply to such receiving as well as transmitting antennas.

While there have been described what are at present considered to be the preferred embodiments of this invention, it will be obvious to those skilled in the art various changes and modifications may be made therein without departing from the invention and it is, therefore, aimed to cover all such changes and modifications as fall within the true spirit and scope of the invention.

What is claimed is:

1. An antenna system for radiating wave energy signals into a selected angular region of space and in a desired radiation pattern comprising:

an aperture comprising a plurality of element groups, each group comprising two or more radiating elements;

a plurality of first coupling means, each for coupling supplied wave energy signals to the elements in a corresponding one of said element groups;

and second coupling means for interconnecting said plurality of first coupling means to cause wave energy signals supplied to any of said first coupling means to be additionally coupled to selected elements in substantially all of the remaining element groups of said aperture with predetermined amplitudes and phases, thereby causing said aperture to radiate wave energy signals primarily in said selected region of space;

whereby when wave energy signals are supplied to each of said first coupling means with a predetermined amplitude and phase, said aperture will radiate wave energy signals in said desired radiation pattern.

2. An antenna system as specified in claim 1 wherein said second coupling means comprises first and second transmission lines coupled to selected portions of said first coupling means.

3. An antenna system as specified in claim 1 wherein each of said first coupling means comprises first and second transmission lines, each for coupling wave energy signals to selected elements in the corresponding element group and means for coupling supplied wave energy signals to said first and second transmission lines.

4. An antenna system as specified in claim 3 wherein said second coupling means comprises first and second transmission lines and wherein said first transmission line in said second coupling means is coupled to each of said first transmission lines in said first coupling means, and said second transmission line in said second coupling means is coupled to each of said second transmission lines in said first coupling means.

5. An antenna system as specified in claim 1 wherein said predetermined amplitudes and phases with which wave energy signals supplied to any of said first coupling means are coupled to selected elements on said aperture comprises an approximately sin $Kx/Kx$ amplitude distribution of wave energy having a substantially linear phase distribution on said aperture, where $x$ is the linear distance along said aperture and K is a selected constant, thereby causing said aperture to radiate wave energy signals with substantially uniform amplitude in said selected sector of space.

6. An antenna system for radiating wave energy signals primarily in a selected angular region of space and in a desired radiation pattern comprising:

an aperture comprising an array of element groups, each group comprising first and second element modules and each modules comprising one or more radiating elements;

a plurality of first coupling means, each corresonding to an element group for coupling supplied wave energy signals to the elements in substantially all of said corresponding first and second element modules, and each including a power divider having first and second outputs;

and second coupling means, including a first transmission line coupled to the first output of each of said power dividers and a second transmission line coupled to the second output of each of said power dividers, for coupling wave energy signals supplied to any of said first coupling means to selected elements in the remaining element groups of said aperture with predetermined amplitudes and phases, thereby causing said aperture to radiate wave energy signals primarily in said selected region of space;

whereby when wave energy signals are supplied to each of said first coupling means with a predetermined amplitude and phase, said aperture will radiate wave energy signals in said desired radiation pattern.

7. An antenna system as specified in claim 6 wherein said aperture comprises a linear array of radiating elements, and wherein each of said modules comprises a selected number of adjacent elements in said linear array.

8. An antenna system as specified in claim 6 wherein wave energy signals supplied to any of said first coupling means are coupled to said first and second element modules in a corresponding element group with substantially equal amplitude.

9. An antenna system as specified in claim 6 wherein said transmission lines in said second coupling means are coupled to the outputs of said power dividers with couplers having substantially the same coupling coefficient.

10. An antenna system as specified in claim 9 wherein said coupling coefficient is approximately 0.69.

11. An antenna system as specified in claim 9 wherein each of said transmission lines in said second coupling means includes means for attenuating signals between each of said first coupling means.

12. An antenna system as specified in claim 11 wherein each of said attenuating means has an equal attenuation coefficient.

13. An antenna system as specified in claim 12 wherein said coupling coefficient is approximately 0.69 and wherein said attenuation coefficient is approximately 0.69.

14. An antenna system as specified in claim 6 wherein each of said transmission lines in said second coupling means include means for attenuating wave energy signals.

15. An antenna system as specified in claim 6 wherein said aperture comprises a linear array of element groups.

16. An antenna system as specified in claim 15 wherein the spacing between corresponding elements in adjacent element groups is less than $\lambda/|\sin\theta_1 - \sin\theta_2|$, where $\lambda$ is the wavelength of said supplied wave energy signals and $\theta_1$ and $\theta_2$ are the angular boundaries of said selected region of space, measured in a plane which includes the axis of said linear array and from a line perpendicular to said axis.

17. An antenna system as specified in claim 6 wherein said first and second transmission lines in said second coupling means are coupled to said first and second power divider outputs at intervals corresponding to an odd integral multiple of half-wavelengths in said transmission lines at the operating frequency of said antenna system.

18. An antenna system as specified in claim 6 wherein said system includes phase adjustment means for coupling supplied wave energy signals to said elements with a selected linear phase progression.

19. An antenna system for radiating wave energy signals in a selected angular region of space and in a desired radiation pattern comprising:

an aperture comprising a linear array of equally spaced antenna elements divided into a plurality of element groups, each group comprising first and second adjacent element modules and each module comprising one or more adjacent radiating elements, all of said modules having the same number of radiating elements;

a number of first coupling means, equal to the number of said element groups and each including a power divider having first and second outputs, for coupling supplied wave energy signals to the elements in corresponding first and second element modules;

and second coupling means, including a first transmission line coupled to the first output of each of said power dividers and a second transmission line coupled to the second output of each of said power dividers, for coupling wave energy signals supplied to any of said first coupling means to selected elements in the remaining element groups of said aperture with predetermined amplitudes and phases, whereby wave energy signals supplied to any of said first coupling means are coupled to the elements in said linear array with an approximately sin $Kx/Kx$ amplitude distribution, where $x$ is the linear distance along said aperture and K is a selected constant, and with an approximately linear phase distribution, thereby causing said aperture to radiate wave energy signals with substantially uniform amplitude primarily in said selected region of space;

whereby when wave energy signals are supplied to each of said first coupling means with a predetermined amplitude and phase, said aperture will radiate wave energy signals in said desired radiation pattern.

20. An antenna system as specified in claim 19 wherein said first and second transmission lines in said second coupling means are coupled to said first and second power divider outputs at intervals corresponding to an odd integral multiple of half-wavelengths in said transmission lines at the operating frequency of said antenna system.

21. An antenna system as specified in claim 19 wherein the spacing between corresponding elements in adjacent element groups is less than $\lambda/|\sin\theta_1 - \sin\theta_2|$, where $\lambda$ is the wavelengths of said supplied wave energy signals and $\theta_1$ and $\theta_2$ are the angular boundaries of said selected region of space measured in a plane which includes the axis of said linear array and from a line perpendicular to said axis.

22. An antenna system for radiating wave energy signals in a selected angular region of space and in a desired radiation pattern comprising:

an aperture comprising an array of element groups, each group comprising first and second element modules and each module comprising one or more radiating elements;

a plurality of first coupling means, each for coupling supplied wave energy signals to the elements in a corresponding element group, each of said first coupling means including a power divider having first and second outputs, corresponding to said first and second element modules, and first and second power combiners for combining supplied wave energy signals and coupling said signals to the elements in said first and second modules, respectively, each of said power combiners having a pair of inputs, one of which is coupled to one of the outputs of said power divider;

and second coupling means, including a first transmission line coupled to the first output of each of said power dividers in said first coupling means and coupled to a selected one of the input ports of each of said power combiners, and a second transmission line coupled to the second output of each of said power dividers in said first coupling means and coupled to the remaining input port of each of said power combiners, for coupling wave energy signals supplied to any of said first coupling means to selected elements in the remaining element groups of said aperture with predetermined amplitudes and phases, thereby causing said aperture to radiate wave energy signals primarily in said selected region of space;

whereby when wave energy signals are supplied to each of said first coupling means with a predetermined amplitude and phase, said aperture will radiate wave energy signals in said desired radiation pattern.

23. An antenna system as specified in claim 22 wherein said first and second transmission lines in said second coupling means are coupled to said first and second power divider outputs at intervals corresponding to an odd integral multiple of half-wavelengths in said transmission lines at the operating frequency of said antenna system.

24. An antenna system for radiating wave energy signals into a selected angular region of space and in a desired radiation pattern comprising:

an aperture comprising a plurality of columns of radiating elements arranged along a predetermined path, each column comprising one or more radiating elements and means for coupling wave energy signals to said elements, said columns being arranged in column groups, each group comprising two or more columns of radiating elements;

a plurality of first coupling means, each for coupling supplied wave energy signals to the columns in a corresponding one of said column groups;

second coupling means for interconnecting said plurality of first coupling means to cause wave energy signals supplied to any of said first coupling means to be additionally coupled to selected columns in substantially all of the remaining column groups of said aperture with predetermined amplitudes and phases, thereby causing said aperture to radiate wave energy signals primarily in said selected region of space;

whereby when wave energy signals are supplied to each of said first coupling means with a predetermined amplitude and phase, said aperture will radiate wave energy signals in said desired radiation pattern.

25. An antenna system as specified in claim 24 wherein said aperture comprises a planar array of radiating elements arranged in parallel columns along a predetermined straight line.

26. An antenna system as specified in claim 25 wherein said columns are equally spaced along said straight line.

27. An antenna system as specified in claim 26 wherein each of said column groups comprises first and second column modules, each comprising one or more columns of radiating elements, and wherein each of said first coupling means couples supplied wave energy signals to said first and second column modules in a corresponding element group and includes a power divider having first and second output ports.

28. An antenna system as specified in claim 27 wherein said second coupling means includes a first transmission line coupled to each of the first output port of each of said power dividers and a second transmission line coupled to the second output of said power dividers.

29. An antenna system as specified in claim 28 wherein said first annd second transmission lines in said second coupling means are coupled to said first and second power divider outputs at intervals corresponding to an odd integral multiple of half-wavelengths in said transmission lines at the operating frequency of said antenna system.

30. An antenna system as specified in claim 25 wherein said selected region of space is a region bounded by a first angle $\theta_1$ and a second angle $\theta_2$ measured from the broadside axis of said planar array in a plane which includes said straight line, and wherein the spacing between corresponding columns in adjacent column groups is less than $\lambda/|\sin\theta_1 - \sin\theta_2|$, wherein $\lambda$ is the wavelength of said supplied wave energy signals.

31. An antenna system for radiating wave energy signals into a selected angular region of space and in a desired radiation pattern, comprising:

an array comprising a plurality of column groups, each column group comprising two or more array columns, each array column comprising:

an aperture comprising a plurality of element groups, each group comprising two or more radiating elements;

a plurality of first coupling means, each for coupling supplied wave energy signals to the elements in a corresponding element group;

second coupling means for interconnecting said plurality of first coupling means to cause wave energy signals supplied to any of said first coupling means to be additionally coupled to selected elements in substantially all of the remaining element groups of said aperture with predetermined amplitudes and phases;

a plurality of third coupling means, each for coupling supplied wave energy signals to selected ones of said first coupling means in array columns within a column group;

and a plurality of fourth coupling means each for interconnecting selected ones of said third coupling means to cause wave energy signals supplied to any of said third coupling means to be additionally coupled to selected ones of said first coupling means in substantially all of the remaining column groups of said array with predetermined amplitudes and phases, thereby causing said apertures to radiate wave energy signals primarily in said selected region of space;

whereby when wave energy signals are supplied to each of said third coupling means with a predetermined amplitude and phase, said aperture will radiate wave energy signals in said desired radiation pattern.

32. An antenna system as specified in claim 31 wherein each of said element groups comprises first and second element modules with each of said element modules comprising one or more radiating elements, and wherein each of said column groups comprises first and second column modules with each of said column modules comprising one or more columns of elements.

33. An antenna system as specified in claim 32 wherein each of said first coupling means couples wave energy signals to the elements in corresponding first and second element modules and includes a power divider having first and second outputs.

34. An antenna system as specified in claim 33 wherein said second coupling means comprises a first transmission line coupled to the first output of each of said power dividers, and a second transmission line coupled to the second output of each of said power dividers.

35. An antenna system as specified in claim 34 wherein said first and second transmission lines in said second coupling means are coupled to said first and second power divider outputs at intervals corresponding to an odd integral multiple of half-wavelengths in said transmission lines at the operating frequency of said antenna system.

36. An antenna system as specified in claim 32 wherein each of said third coupling means couples wave energy signals to the corresponding first coupling means in said corresponding first and second column modules and includes a power divider having first and second outputs.

37. An antenna system as specified in claim 36 wherein each of said fourth coupling means includes a plurality of first transmission lines each coupled to the first output of selected power dividers in said third coupling means, and a plurality of second transmission line each coupled tto the second output of selected power dividers in said third coupling means.

38. An antenna system as specified in claim 37 wherein said first and second transmission lines in each of said fourth coupling means are coupled to said first and second power divider outputs at intervals corresponding to an odd integral multiple of half-wavelengths in said transmission lines at the operating frequency of said antenna system.

* * * * *